US005759067A

United States Patent [19]

Scheer

[11] Patent Number: 5,759,067

[45] Date of Patent: Jun. 2, 1998

[54] SHIELDED CONNECTOR

[76] Inventor: Peter L. Scheer, 862 Country Club Rd., Camp Hill, Pa. 17011

[21] Appl. No.: 763,486

[22] Filed: Dec. 11, 1996

[51] Int. Cl.[6] ..... H01R 13/648

[52] U.S. Cl. ..... 439/607; 439/76.1; 439/620

[58] Field of Search ..... 439/76.1, 607, 439/609, 620, 676, 621; 361/748, 752

[56] References Cited

U.S. PATENT DOCUMENTS

| | | | |
|---|---|---|---|
| 4,329,665 | 5/1982 | Kawai et al. . | |
| 4,729,752 | 3/1988 | Dawson, Jr. et al. | 439/620 |
| 5,040,097 | 8/1991 | Stribel | 361/395 |
| 5,069,641 | 12/1991 | Sakamoto et al. | 439/620 |
| 5,282,759 | 2/1994 | Sakamoto et al. | 439/620 |
| 5,403,207 | 4/1995 | Briones | 439/620 |
| 5,456,619 | 10/1995 | Belopolsky et al. | 439/620 |

FOREIGN PATENT DOCUMENTS

| | | |
|---|---|---|
| 0128380 | 5/1989 | Japan . |
| 0267879 | 11/1990 | Japan . |

*Primary Examiner*—Khiem Nguyen

[57] ABSTRACT

A shielded connector assembly includes a first printed circuit board having an inner face directed toward an interior of the assembly and an outer face directed toward an exterior of the assembly. The first printed circuit board has a plurality of media filters formed on at least one face thereof. A plurality of optional light emitting diodes are mounted to the inner face of the first printed circuit board, and a plurality of terminal inserts are mounted to the inner face of the first printed circuit board. A housing member is provided for receiving the first printed circuit board having the described components mounted thereon.

24 Claims, 4 Drawing Sheets

SHIELDED CONNECTOR

BACKGROUND OF THE INVENTION

1. Field of the Invention

The present invention is directed to a shielded connector including a stacked assembly having media filters, optional light emitting diodes, and connectors.

2. Description of Related Art

The current state of the art commonly utilizes individual discrete components to mount input/output connectors, light emitting diodes, and media filters in a printed circuit board layout. The use of the discrete components causes considerable difficulty in arranging a layout for the printed circuit board and consumes a significant amount of space on the printed circuit board. This is true in both single and dual row connector configurations. For example, the space consumed by a stacked (a dual row) connector is much more than twice a single row connector due to trace routings and the bulk of the media filters. Accordingly, a problem exists in the art when assembling a shielded connector to include input/output connectors, light emitting diodes, and media filters, due to the limited space requirements for mounting the same on a printed circuit board.

SUMMARY OF THE INVENTION

The present invention relates to a shielded connector assembly which utilizes vertically stacked components in order to maximize the use of space within the assembly. The vertical stacking of components is effective with any industry port requirements, including single high multiple ports, and multiple high multiple ports.

As a result of the shielded connector assembly, efficient use of space and a low-cost device is obtained.

Objects, Features, and Advantages

Accordingly, it is an object of this invention to provide a shielded connector assembly in which input/output connectors, media filters and optional light emitting diodes are mounted as closely together as possible.

It is a further object of this invention to provide a shielded connector assembly in which media filters and optional light emitting diodes are mounted in a stacked relationship on a vertically oriented printed circuit board.

It is still another object of this invention to provide a shielded connector assembly in which an arrangement of components including media filters, terminal inserts and optional light emitting diodes are all accommodated on a single vertically oriented printed circuit board.

It is a still further object of the present invention to provide a stacked assembly for a shielded connector which is compact and low cost.

These and other objects of the invention are realized by providing a shielded connector assembly having a first printed circuit board vertically oriented within the assembly, the first printed circuit board having an inner face directed toward an interior of the assembly and an outer face directed toward an exterior of the assembly. A second printed circuit board is positioned transverse to the first printed circuit board.

A housing member is provided for receiving the first printed circuit board, the housing member including a first face having a plurality of jack ports formed therein, and a second face on a diametrically opposing side of the housing member from the first face. A shield member surrounds the housing member.

The improvement of the device includes providing a plurality of media filters on at least one face of the first printed circuit board, each of the plurality of media filters having a one to one correspondence with respect to the plurality of jack ports, a plurality of optional light emitting diodes mounted to the inner face of the first printed circuit board at a peripheral face edge thereof, and a plurality of terminal inserts mounted to the inner face of the first printed circuit board. A plurality of optional light pipes (used in the event light emitting diodes are utilized) are mounted in the housing portion for transmitting light from a corresponding one of the plurality of light emitting diodes to the first face of the housing, and a recessed portion is formed in the second face of the housing. The recessed portion is defined by a setback wall member, the setback wall member having a plurality of openings formed therein, each of the plurality of openings being aligned with the plurality of jack ports in a one-to-one correspondence. The optional light emitting diodes are positioned at outer peripheral edges of the first printed circuit board, the terminal inserts are positioned interiorly of the light emitting diodes, the media filters are positioned interiorly of the terminal inserts, and the light pipes are aligned with the light emitting diodes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the invention will now be described by way of example with reference to the accompanying drawings in which.

DETAILED DESCRIPTION OF PREFERRED EMBODIMENTS

Referring to FIGS. 1, 2, 3, and 4 there are shown exploded perspective views and side views of the shielded connector assembly according to a first embodiment of the present invention.

At the outset, it should be understood that the present invention as disclosed by the following, may be configured as a horizontal arrangement or a vertical arrangement. It is particularly an option to configure a single high row of ports or a single port in a horizontal arrangement. When more than a single high multiple ports are present, economy of scale has led to the invention of the vertically arranged elements as described hereinbelow. Additionally, consumers may not always desire the inclusion of a light emitting diode with the disclosed assembly, and it should therefore be understood that the light emitting diode (and hence light pipes) may be optionally installed by the consumer, and this ability does not detract from the scope of the invention.

Figure 3:
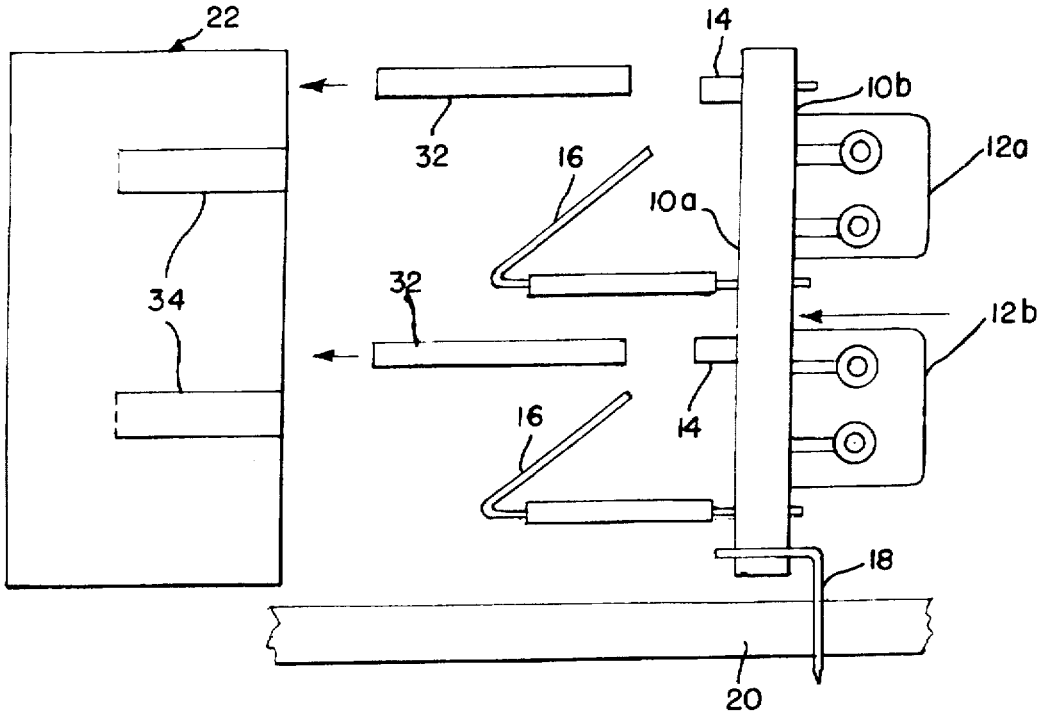
FIG. 3 is a side view of the disassembled shielded connector assembly according to FIG. 1 with optionally configured terminal inserts.
Figure 4:
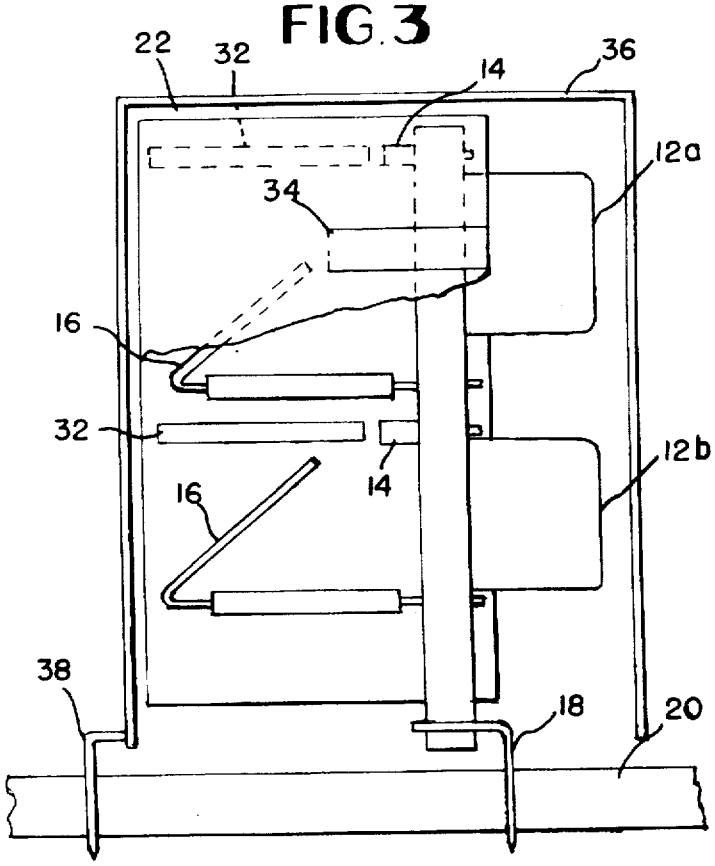
FIG. 4 is a side view of the assembled shielded connector assembly according to FIG. 3.

The shielded connector assembly includes a vertically oriented mini printed circuit board (PCB) 10 which functions as a base structure for the remainder of the assembly. The mini PCB 10 includes an inner face 10*a* and an outer face 10*b*. A plurality of media filters 12 (see FIGS. 3 and 4) are mounted to the mini PCB 10 in a stacked orientation, with, for example, two pairs of media filters 12 on the outer face 10*b* of the mini PCB 10. As shown in FIGS. 3 and 4, an upper pair of media filters 12*a* are positioned above a lower pair of media filter 12*b*, with both pairs of media filters 12*a* and 12*b* on the same face of the mini PCB 10.

Figures 1, 2:
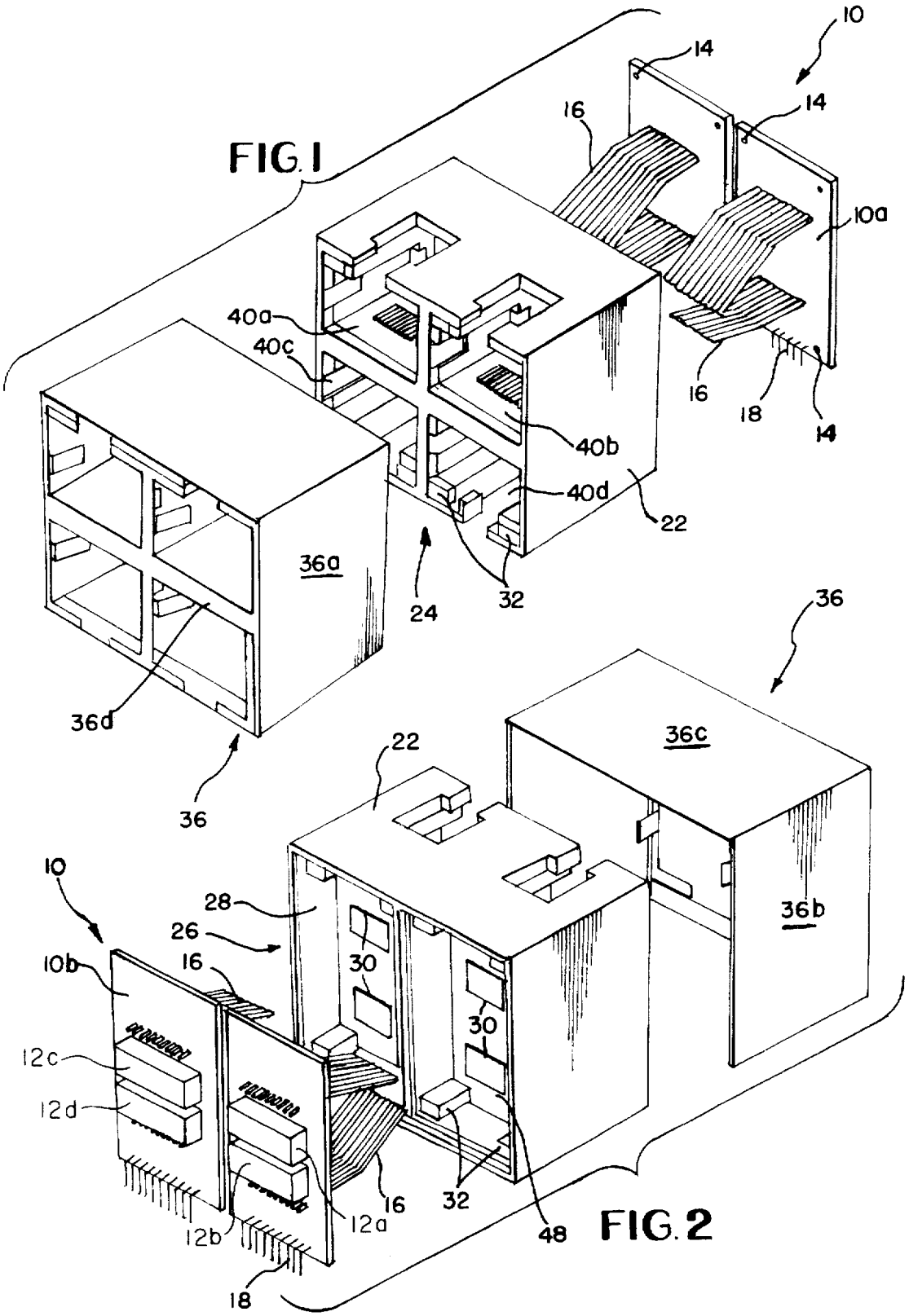
FIG. 1 is an exploded right side perspective view of a shielded connector assembly according to a first embodiment of the present invention.
FIG. 2 is an exploded left side perspective view of the shielded connector assembly according to FIG. 1.

A plurality of optional light emitting diodes 14 (LED's) are mounted on the inner face 10*a* of the mini PCB 10 at predetermined locations. Additionally, a plurality of terminal inserts 16 are mounted to the mini PCB 10 such that the connector ends thereof protrude from the inner face 10*a* of the mini PCB 10. The terminal inserts 16 are mounted so as to provide electrical contact with mating plug connectors (not shown) inserted into a respective jack port 40. Preferably, the terminal inserts 16 extend from the inner face 10*a* of the mini PCB and be bent at a moderate obtuse angle with respect to a horizontal plane. This preferred structure is shown in FIGS. 1 and 2. However, it is also possible to bend the terminal inserts 16 at right angles or greater as shown, for example only, in FIGS. 3 through 8 so that a plug connector (not shown) inserted into a respective jack port 40 will immediately contact the terminal insert 16. Therefore, either the preferred obtuse angle of FIGS. 1 and 2 may be utilized, or optionally the bent angle of more than 90 degrees as shown in FIGS. 3 through 8 may be utilized in any of the embodiments shown.

Additionally, at least one electrical connector pin 18 extends through the mini PCB 10 and into a second printed circuit board 20 (mother board) for electrically connecting the mini PCB 10 to the mother board 20. The mother board 20 is oriented in a horizontal position so as to be substantially perpendicular with respect to the mini PCB 10.

A plastic housing 22 is provided in connection with the mini PCB 10. The plastic housing 22 includes a first face 24 and a second face 26 as best shown in FIGS. 1 and 2 and opposing side walls which are not numbered. Media filters 12*a*–12*d* are mounted on the outer face 10*b* of PCB 10 as shown in FIGS. 1 and 2. Alternatively, the media filters may be mounted on the inner face 10*a*. A recessed area 28 is formed in the second face 26 as shown in FIG. 2. The recessed area 28 is of a size to accommodate the terminal inserts 16 and additionally accommodate the media filters 12. A plurality, such as four, jack ports 40 are formed in the first face 24 of the connector housing 22 as shown. The jack ports 40 are preferably formed as an upper pair of ports 40*a*, 40*b*, and a lower pair of ports 40*c*, 40*d* in correspondence with the upper and lower pairs of media filters 12*c* and 12*d* in the second face 26 of the connector housing 22, such that proper alignment is obtained between connected parts of the assembly. It should be understood that any number of jack ports 40 may be utilized as explained at the outset, and that the number of jack ports will determine the corresponding number of the plurality of media filters 12, optional light emitting diodes 14, and terminal inserts 16, such that a one-to-one correspondence exists between the identified elements.

A plurality of light pipes 32 are positioned in the housing 22 in the event that light emitting diodes are present. The light pipes 32 are used to carry light to the second face 26 of the connector housing 22. Generally, a single light pipe 32 will be used for a single light emitting diode 14. Accordingly, the connector housing 22 holds the light pipes 32 while also holding the terminal inserts 16. The housing 22 retains the plurality of light pipes 32 and the terminal inserts 16 by snapping over the mini PCB 10 using a retention member 34. No specific form of the retention member 34 is required and the retention member 34 may, for example, be a clip or a snapping strap or the like so as to secure the mini PCB 10 to the housing. The size and shape of the retention member 34 may be altered to suit the particular shape of the housing 22 and mini PCB 10.

A shield 36 composed of, for example, metal, is formed as a partial box having a pair of side members 36*a* and 36*b*, an upper portion 36*c*, a front face 36*d*, and a rear face 36*e*. In FIG. 2, the rear face 36*e* of the shield 36 is removed for purposes of clarity and the shield 36 is entirely removed in FIGS. 3, 5, and 7 for purposes of clarity. The front face 36*d* of the shield 36 corresponds in shape to the jack ports 40 in the first face 24 of the housing 22. The shield 36 snaps over the housing 22 and is secured to the mother board 20 with a plurality of connector pins 38. While the connector pins are shown in the rear wall of the shield 36, the plurality of pins could be in any electrically appropriate location, including a side wall of the shield 36.

The optional light emitting diodes 14 are mounted above the respective jack ports 40 as is preferred in the industry.

Figure 5:
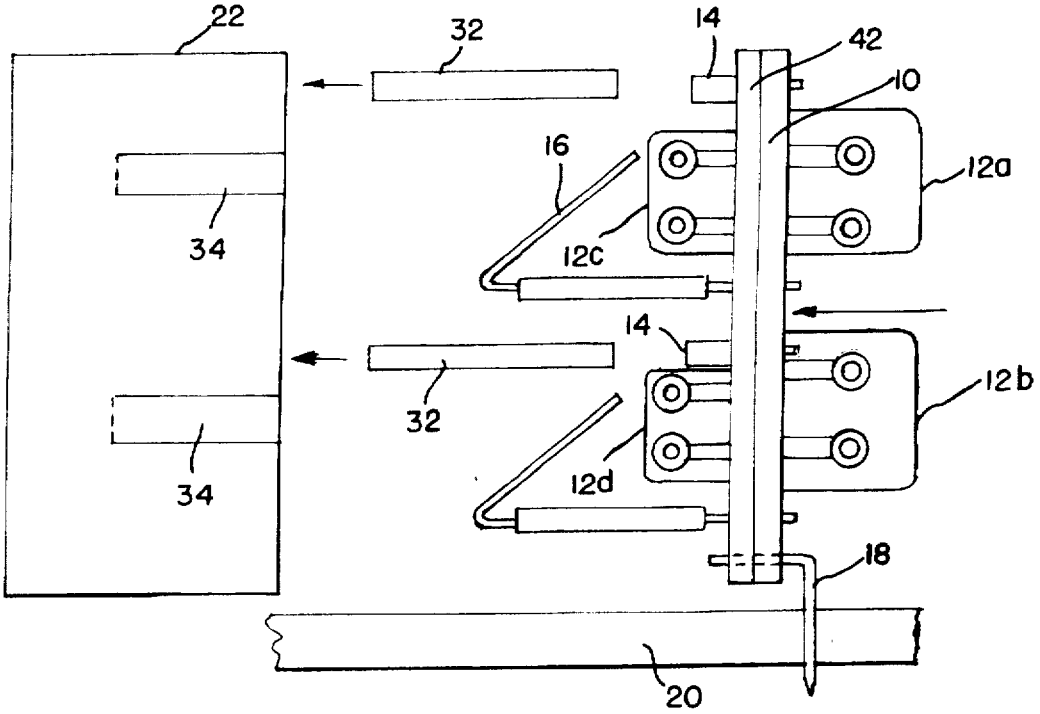
FIG. 5 is an exploded side view of a dis-assembled shielded connector assembly according to a second embodiment of the present invention.
Figure 6:
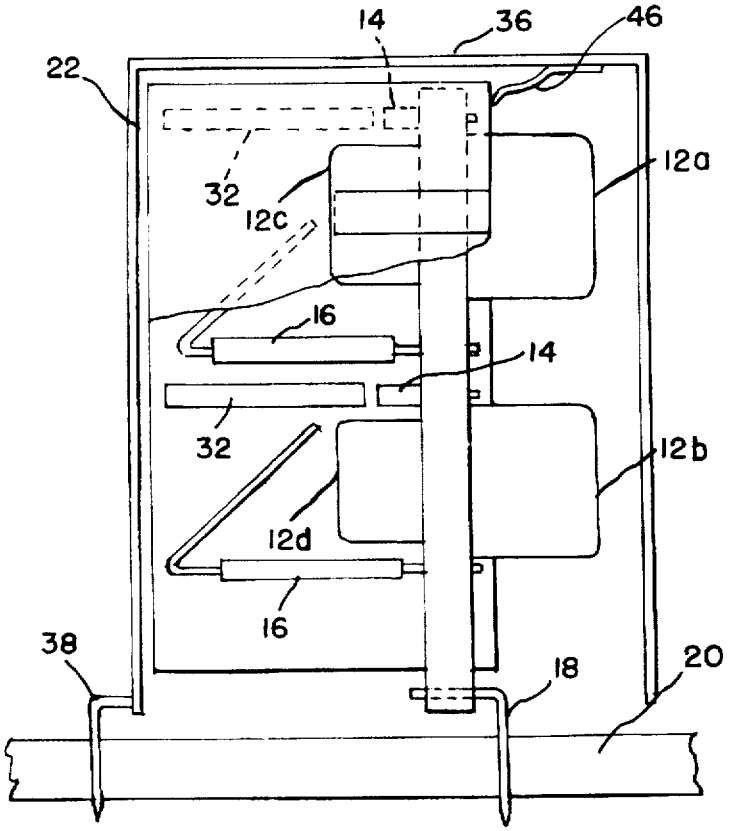
FIG. 6 is a side view of the assembled shielded connector assembly according to FIG. 5 of the present invention.

FIGS. 5 and 6 are directed to a second preferred embodiment of the present invention. Those parts which are identical to the parts of FIGS. 1 through 4 include like reference numerals for the sake of clarity. The purpose of the embodiment shown in FIGS. 5 and 6 is to illustrate optional layouts for the plurality of media filters 12.

Specifically, the media filters 12*a* and 12*b* are designed to be present on an opposing side of the mini PCB 10 as illustrated by elements 12*c* and 12*d* as shown in the embodiment of FIGS. 5 and 6. The media filters 12*c* correspond to the upper pair of media filters 12*a* and the media filters 12*d* correspond to the lower pair of media filters 12*b*. Thus, as shown the media filters labeled as 12*a* and 12*c* are in fact a single media filter 12 for the jack port 40 to which they correspond. Similarly, the media filters labeled as 12*b* and 12*d* are a single media filter 12 for the jack port to which they correspond. The media filters 12*a*–12*d* typically include a series of coils 48 comprising either a transformer configuration, a common mode choke or both. Conductive wires 50 electrically interconnect the constituent coils 48 of the media filter 12 to traces on the PCB 10 and the transmit and receive line pairs of the respective port 40.

Additionally, an option exists in FIGS. 5 and 6 to provide at least one additional layer 42 to the mini PCB 10. The additional layer 42 provides a ground path or can be used for additional trace routings. It is understood in the industry that by separating the receiving and transmitting circuits with a ground plane, cross talk will be reduced.

Figure 8:
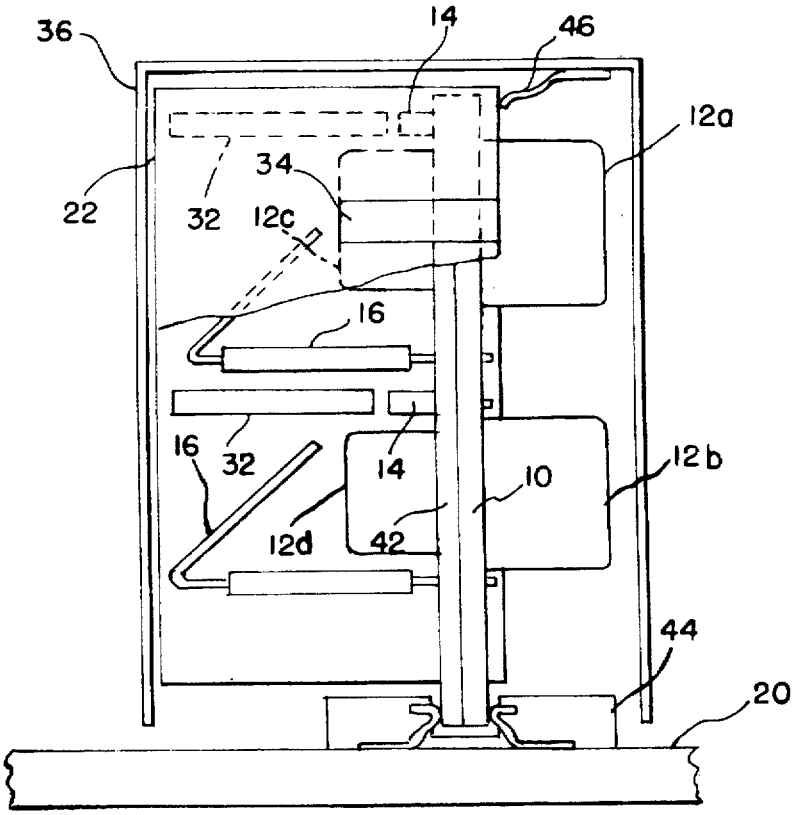
FIG. 8 is a side view of the assembled shielded connector assembly according to FIG. 7 of the present invention.

Further, there is illustrated an optional grounding element 46 in FIGS. 6 and 8 for ensuring that the shield 36 of the assembly is always grounded.

Figure 7:
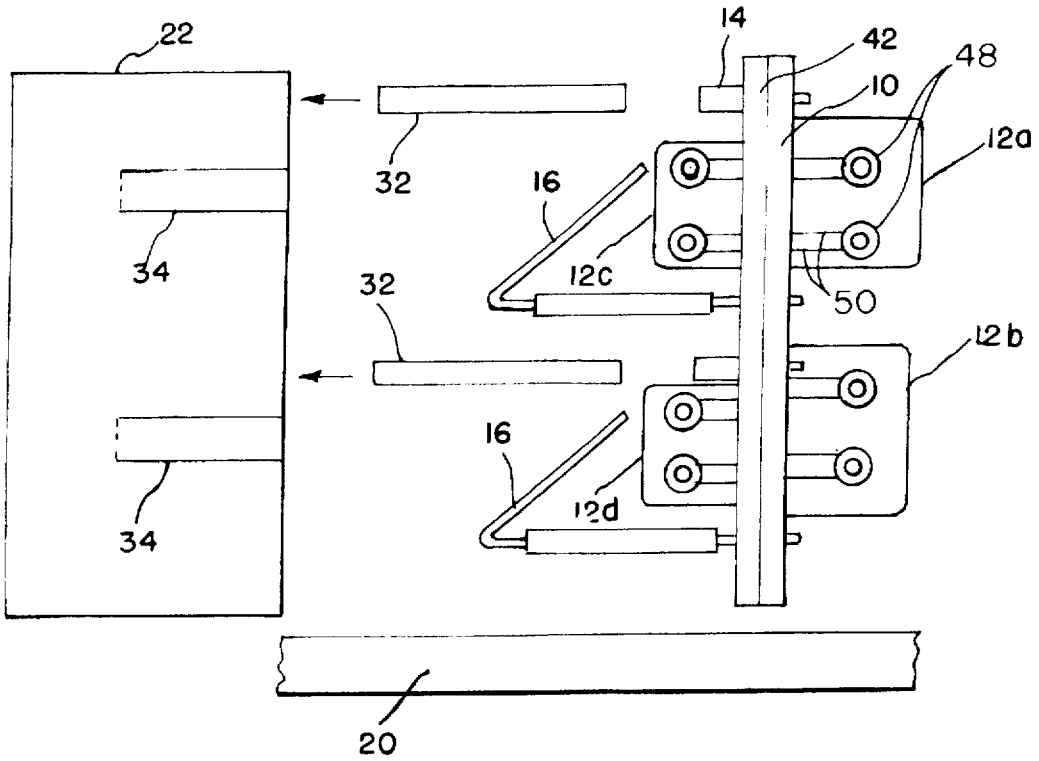
FIG. 7 is an exploded side view of a dis-assembled shielded connector assembly according to a third embodiment of the present invention.

Referring now to the embodiment shown in FIGS. 7 and 8, like reference numerals refer to like parts and will not be repeated herein for the sake of brevity. The embodiment of FIGS. 7 and 8 illustrates the addition of a card edge connector 44 which is used to provide a connection between the mini PCB 10 and the mother board 20.

As an alternative to the use of a single mini PCB 10, a pair of mini PCB's 10 may be utilized, each mini PCB 10 having the first face 10*a* and second face 10*b*. A single mini PCB is utilized for each of the plurality of jack ports 40. This alternative is presently illustrated in FIGS. 1 and 2. As a further alternative, the mini PCB 10 may be a double sided board of a single layer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A shielded connector assembly, comprising:

a first printed circuit board oriented vertically with respect to the assembly and having an inner face directed toward an interior of the assembly and an outer face directed toward an exterior of the assembly, said first printed circuit board including a plurality of media filters formed on at least one face of said first printed circuit board, and a plurality of terminal inserts mounted to the inner face of said first printed circuit board;

a housing member for receiving said first printed circuit board, said housing member including a first face having a plurality of jack ports formed therein, and a second face having a recessed portion defined by a setback wall member, the setback wall member having a plurality of openings formed therein, each of said plurality of openings being aligned with said plurality of jack ports in a one-to-one correspondence;

a second printed circuit board positioned transverse to said first printed circuit board;

means for electrically connecting said first printed circuit board to said second printed circuit board;

a shield member substantially surrounding said housing member, said shield member including a plurality of openings formed in one side thereof aligned with and corresponding in size to said plurality of jack ports; and means for connecting said shield member to said second printed circuit board.

2. The shielded connector assembly according to claim 1, further comprising a plurality of light emitting diodes mounted to the inner face of said first printed circuit board and a plurality of light pipes for transmitting light from a corresponding one of said plurality of light emitting diodes to the first face of said housing.

3. The shielded connector assembly according to claims 1 or 2, wherein said plurality of media filters are formed on at least the outer face of said first printed circuit board.

4. The shielded connector assembly according to claims 1 or 2, wherein the recessed portion of said housing member is of a size and location to receive said plurality of media filters.

5. The shielded connector assembly according to claims 1 or 2, wherein said means for electrically connecting said first printed circuit board to said second printed circuit board includes a plurality of electrical connector pins mounted to said first printed circuit board and inserted into said second printed circuit board.

6. The shielded connector assembly according to claims 1 or 2, wherein said means for connecting said shield member to said second printed circuit board includes a plurality of shield pins mounted to said shield member and inserted into said second printed circuit board.

7. The shielded connector assembly according to claims 1 or 2, wherein said shield member is a metal shield.

8. The shielded connector assembly according to claims 1 or 2, wherein said housing member is formed of plastic.

9. The shielded connector assembly according to claims 1 or 2, wherein said first printed circuit board is a mini printed circuit board.

10. The shielded connector assembly according to claims 1 or 2, wherein said first printed circuit board includes a double sided board of a single layer.

11. The shielded connector assembly according to claim 2, wherein said light emitting diodes are positioned at outer edges of said first printed circuit board, said terminal inserts are positioned interiorly of said light emitting diodes, said media filters are positioned interiorly of said terminal inserts, and said light pipes are aligned with said light emitting diodes.

12. A shielded connector assembly having a first printed circuit board oriented vertically with respect to the assembly, the first printed circuit board having an inner face directed toward an interior of the assembly and an outer face directed toward an exterior of the assembly, a second printed circuit board positioned transverse to said first printed circuit board, a housing member for receiving said first printed circuit board, said housing member including a first face having a plurality of jack ports formed therein, and a second face on a diametrically opposing side of said housing member from said first face, and a shield member substantially surrounding said housing member, the improvement comprising:

a plurality of media filters formed on at least one face of said first printed circuit board;

a plurality of terminal inserts mounted to the inner face of said first printed circuit board; and a recessed portion formed in the second face of said housing, said recessed portion being defined by a setback wall member, the setback wall member having a plurality of openings formed therein, each of said plurality of openings being aligned with said plurality of jack ports in a one-to-one correspondence.

13. The shielded connector assembly according to claim 12, further comprising a plurality of light emitting diodes mounted to the inner face of said first printed circuit board at a peripheral face edge thereof and a plurality of light pipes mounted in said recessed portion for transmitting light from a corresponding one of said plurality of light emitting diodes to the first face of said housing.

14. The shielded connector assembly according to claim 13, wherein said light emitting diodes are positioned at outer peripheral edges of said first printed circuit board, said terminal inserts are positioned interiorly of said light emitting diodes, said media filters are positioned interiorly of said terminal inserts, and said light pipes are aligned with said light emitting diodes.

15. The shielded connector assembly according to claims 12, 13 or 14, further comprising means for electrically connecting said first printed circuit board to said second printed circuit board.

16. The shielded connector assembly according to claim 12, 13, or 14, further comprising means for connecting said shield member to said second printed circuit board.

17. The shielded connector assembly according to claims 12, 13 or 14, wherein said plurality of media filters are formed on at least the outer face of said first printed circuit board.

18. The shielded connector assembly according to claims 12, 13, or 14, wherein the recessed portion of said housing member is of a size and location to receive said plurality of media filters formed on the inner face of said first printed circuit board.

19. The shielded connector assembly according to claim 15, wherein said means for electrically connecting said first printed circuit board to said second printed circuit board includes a plurality of electrical connector pins mounted to said first printed circuit board and inserted into said second printed circuit board.

20. The shielded connector assembly according to claim 16, wherein said means for connecting said shield member to said second printed circuit board includes a plurality of shield pins mounted to said shield member and inserted into said second printed circuit board.

21. The shielded connector assembly according to claims 12, 13, or 14, wherein said shield member is a metal shield.

22. The shielded connector assembly according to claim 12, 13, or 14, wherein said housing member is formed of plastic.

23. The shielded connector assembly according to claim 12, 13, or 14, wherein said first printed circuit board is a mini printed circuit board.

24. The shielded connector assembly according to claim 12, 13 or 14, wherein said first printed circuit board includes a double-sided board of one layer.

* * * * *